US005406166A

United States Patent [19]

Abe et al.

[11] Patent Number: 5,406,166

[45] Date of Patent: Apr. 11, 1995

[54] LONG LIFE SPARK PLUG HAVING CONSUMABLE DISCHARGE MEMBER

[75] Inventors: Nobuo Abe, Yokkaichi; Kozo Takamura, Nagoya; Akio Katoh, Nishio, all of Japan

[73] Assignee: Nippondenso Co., Ltd., Kariya, Japan

[21] Appl. No.: 951,199

[22] Filed: Sep. 28, 1992

[30] Foreign Application Priority Data

Sep. 30, 1991 [JP] Japan ..... 3-251924
Aug. 7, 1992 [JP] Japan ..... 4-211476

[51] Int. Cl.[6] ..... H01T 13/20

[52] U.S. Cl. ..... 313/142; 313/141; 123/169 EL

[58] Field of Search ..... 313/142, 141, 123; 123/169 EL

[56] References Cited

U.S. PATENT DOCUMENTS 4,122,366 10/1978 von Stutterheim et al. ..... 313/142
4,581,558 4/1986 Takamura et al. ..... 313/142
4,670,684 6/1987 Kagawa et al. ..... 313/142
4,840,594 6/1989 Moore ..... 313/141
5,007,389 4/1991 Kashiwara et al. .
5,202,601 4/1993 Takamura et al. ..... 313/142

FOREIGN PATENT DOCUMENTS 435202 7/1991 European Pat. Off. .
53-64925 5/1978 Japan .
59-33949 8/1984 Japan .

*Primary Examiner*—Donald J. Yusko
*Assistant Examiner*—Matthew J. Esserman
*Attorney, Agent, or Firm*—Cushman, Darby & Cushman

[57] ABSTRACT

There is disclosed a spark plug which can maintain a low spark voltage for a long period of time even if a noble metal tip is used in a small amount. A discharge gap is formed between a central electrode and an earth electrode. The noble metal tip is formed on that end face of the central electrode facing the earth electrode. A cross-shaped groove is formed in that end face of the noble metal tip joined to the central electrode. The cross-shaped groove is exposed when the noble metal tip is consumed by a discharge developing in the discharge gap.

14 Claims, 5 Drawing Sheets

FIG. 2
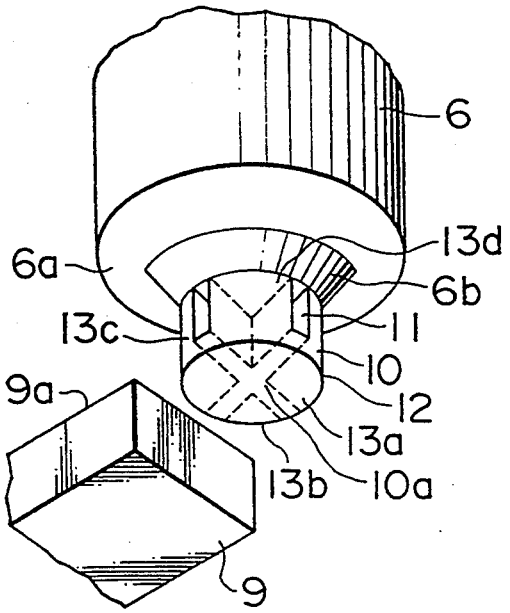
FIG. 3(b)
FIG. 3(d)
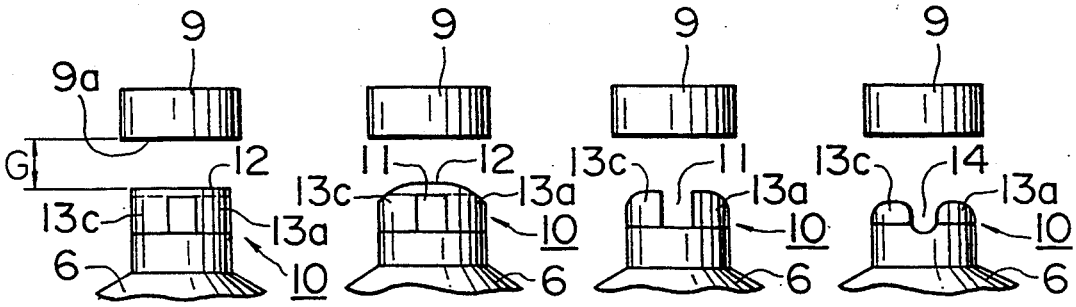
FIG. 3(a)
FIG. 3(c)

LONG LIFE SPARK PLUG HAVING CONSUMABLE DISCHARGE MEMBER

BACKGROUND OF THE INVENTION

This invention relates to a spark plug and a method of producing the same, and more particularly to a spark plug whose spark voltage can be kept to a low level for a long period of time and a method of producing such a spark plug.

Recently, internal combustion engines used, for example, in automobiles, have been required to have an energy-saving design to achieve a low fuel consumption, and therefore a high-compression design of the internal combustion engine, as well as a lean burn design using a lean air-fuel mixture, has been adopted.

As a result of such high-compression design and such lean burn design of the internal combustion engine, the spark voltage of a spark plug needs to be high so as to ignite the lean mixture. Meanwhile, considering recent automobile circumstances, despite a limited capacity of a battery of the automobiles, the electric power consumption has been increased. For this reason, a demand for low spark voltage of the spark plug has now been required.

To meet such requirement, there have been proposed spark plugs which can produce an electrical discharge with a spark voltage much lower than before. For example, Japanese Patent Examined Publication No. 59-33949 and Japanese Utility Model Unexamined Publication No. 53-64925 disclose a spark plug of the type in which a groove (or recess-projection portion) is formed at or near a discharge surface of a central electrode. As a result of thus forming the recess-projection portion at the discharge surface of the electrode, edges are formed at the discharge surface, and these edges cause a spark to easily leap, thereby enabling the low spark voltage.

In the discharge surface construction of the above electrode, in order to maintain the low spark voltage effect for a long period of time, it is necessary that the recess-projection portion should remain to the last even when the consumption of the electrode proceeds. Therefore, in view of the lifetime of the spark plug (that is, the amount of exhaust of the discharge portion due to the electrode consumption) which is another important factor in the design of the spark plug, the groove or the recess-projection portion must have sufficient initial dimensions or depth. However, the discharge surface of the above configuration is small in cross-sectional area because of the provision of the groove or the recess-projection portion, and is subjected to a very severe consumption, and therefore the depth of the groove must be very large in order to maintain the low spark voltage effect for a long period of time.

The low spark voltage effect obtained with the conventional discharge surface of the above configuration will now be described in detail with reference to FIG. 9.

FIGS. 9(*a*) to (*d*) show the shape of the discharge portion 90 of the above electrode which varies with the spark discharge time.

As shown in FIG. 9(*a*), a discharge gap is formed by a discharge surface of an earth electrode (not shown) and a discharge surface 90*a* defined by a cross-shaped groove of the discharge portion 90 of the central electrode, and therefore the discharge can be effected more easily at edges 90*b*, provided by the cross-shaped groove, as compared with a flat discharge surface having no recess and no projection. Therefore, at an initial stage of the discharge, the spark voltage can be made sufficiently low. Thereafter, as the discharge time becomes long with the discharge portion 90 consumed, the edges 90*b* of the discharge surface 90*a* of the discharge portion 90 become rounded, as shown in FIGS. 9(*b*) and 9(*c*). As a result, the spark discharge voltage increases, and sector-shaped pillar portions 95 separated from one another by the cross-shaped groove become short as the consumption of the discharge portion 90 proceeds.

When the discharge further continues, the pillar portions 95 of the discharge portion 90 become sufficiently short to finally reach a flat portion 90*c* of the discharge portion 90, as shown in FIG. 9(*d*). Thus, the edges 90*b* at which the discharge can be effected easily are eliminated, so that the spark voltage reduction effect is lost.

Therefore, with the configuration of the conventional discharge portion 90, the lifetime of the discharge portion 90 can be prolonged only by increasing the height of the sector-shaped pillar portions 95, in which case the flat portion 90*c* of the discharge portion 90 becomes useless, and besides there has been encountered a problem that it is very difficult to form a deep cross-shaped in the discharge surface.

More particularly, in the conventional spark plug in which the recess-projection portion is formed at the discharge end of the electrode in order to achieve the low spark voltage effect, it is difficult to maintain the low spark voltage effect for a long period of time, and the flat portion of the discharge portion is useless. Furthermore, the machining of the discharge portion to form the groove is difficult.

Further, the following problems have also been encountered where the discharge portion of the above configuration is formed by a separate discharge member.

Namely, for fixedly securing the discharge member of the above configuration to the central electrode, a flat portion of the discharge member has heretofore been welded to the end face of the central electrode by resistance welding. However, in the case where the recess-projection portion is formed at the discharge member, the cross-sectional area of the discharge member is smaller at that portion than at the flat portion, and therefore the discharge member can be easily buckled at its recess-projection portion by the heat and pressure applied during the resistance welding. Therefore, conventionally, after the discharge member is joined to the central electrode by resistance welding, the discharge portion must be cut or worked by a sheet-like cutter or the like to form the groove or the recess-projection portion.

However, in such a production method, a considerable amount of the material is cut or removed from the discharge member in order to form the groove or the recess-projection portion. Thus, much time and labor are needed, and therefore this method is not economical, and the production efficiency is low.

SUMMARY OF THE INVENTION

With the above problems in view, it is an object of this invention to provide a spark plug in which a low spark voltage effect can be maintained for a long period of time.

Another object of the invention is to provide a method of producing such a spark plug without wasting a material of a discharge member.

According to a first aspect of the present invention, there is provided a spark plug comprising a pair of electrodes one of which has a surface opposed to the other electrode, a discharge gap being formed between the opposed surfaces of the two electrodes; wherein a discharge portion is formed on the opposed surface of the one electrode in such a manner that edges becomes exposed on the discharge portion when the discharge portion is consumed to a predetermined level by a discharge in said discharge gap.

According to a second aspect of the invention, there is provided a spark plug comprising a pair of electrodes one of which has a surface opposed to the other electrode, a discharge gap being formed between the opposed surfaces of the two electrodes; wherein the one electrode has a discharge portion formed thereon, the discharge portion having a flat portion of a predetermined thickness facing the other electrode, and a recess-projection portion provided between the flat portion and the one electrode.

According to a third aspect of the invention, there is provided a spark plug comprising a pair of electrodes one of which has a surface opposed to the other electrode, a discharge gap being formed between the opposed surfaces of said two electrodes; wherein the one electrode has a discharge member which has one surface opposed to the other electrode, and another surface facing away from the one surface, a groove being formed in the another surface of the discharge member, and the another surface of the discharge member being joined to the one electrode.

According to a fourth aspect of the invention, there is provided a method of producing a spark plug comprising the steps of:

providing a spark plug which comprises a pair of electrodes one of which has a surface opposed to the other electrode, a discharge gap being formed between the opposed surfaces of the two electrodes;

providing a discharge member having a recess-projection portion at one surface thereof; and joining the one surface of the discharge member, having the recess-projection portion, to the opposed surface of the one electrode.

In the spark plug of the first aspect, the opposed electrodes are hardly consumed at an initial stage of the spark discharge, and therefore the discharge can be obtained at a sufficiently low spark voltage.

Then, when the discharge of the spark plug continues, the discharge portion of the electrode is consumed to increase the spark gap, which would increase the discharge voltage; however, when a predetermined amount of the discharge portion is consumed, edges in the discharge portion are exposed, and these edges cause the spark discharge to be produced easily, thereby promoting the reduction of the discharge voltage. Therefore, in this spark plug, the increase of the discharge voltage due to the widening of the spark gap resulting from the consumption of the discharge portion can be prevented.

In the spark plugs of the second and third aspects, the opposed electrodes are hardly consumed at an initial stage of the spark discharge, and therefore the spark gap is narrow, and the discharge can be obtained at a sufficiently low spark voltage.

Then, when the discharge of the spark plug continues, the flat portion of the discharge member facing the other electrode is consumed to increase the spark gap, so that the discharge voltage increases; however, when this flat portion is consumed, the recess-projection portion formed in the discharge member is exposed, so that the edges are formed on the surface of the discharge member facing the other electrode. These edges cause the spark discharge to be produced easily, thereby promoting the reduction of the discharge voltage. Therefore, in this spark plug, the increase of the discharge voltage due to the widening of the spark gap resulting from the consumption of the discharge portion can be prevented.

Further, the low spark voltage effect can be maintained until the discharge member is completely consumed, and therefore the low voltage effect can thus be maintained for a long period of time.

According to the fourth aspect of the invention, the recess-projection portion is formed at one surface of the discharge member, and then the one surface of the discharge member having this recess-projection portion is joined to the other electrode. Thus, the entire one surface of the discharge member, which is preferably a noble metal tip, does not need to be welded to the electrode, as is the case with the prior art, but merely the projected portion on one surface needs to be welded to the discharge surface of the electrode. Therefore, the noble metal tip can be joined to the electrode by resistance welding at a lower temperature and lower pressure than those heretofore required. Therefore, the noble metal tip does not easily buckle at its recess-projection portion, and there can be obtained the spark plug having the welded noble metal tip of a good quality.

According to the first to third aspects of the invention, there can be obtained the spark plug which can effect the discharge at the low voltage for a long period of time.

According to the fourth aspect of the invention, the discharge member is not wasted, for example, by cutting, and therefore the spark plug can be produced economically.

BRIEF DESCRIPTION OF THE DRAWINGS

FIG. 2 is an enlarged view showing a noble metal tip of the spark plug of FIG. 1 and its surroundings;

FIGS. 3(*a*) to (*d*) are schematic views showing the degree of consumption of the noble metal tip proceeding with the discharge time;

DESCRIPTION OF THE PREFERRED EMBODIMENTS

Figure 1:
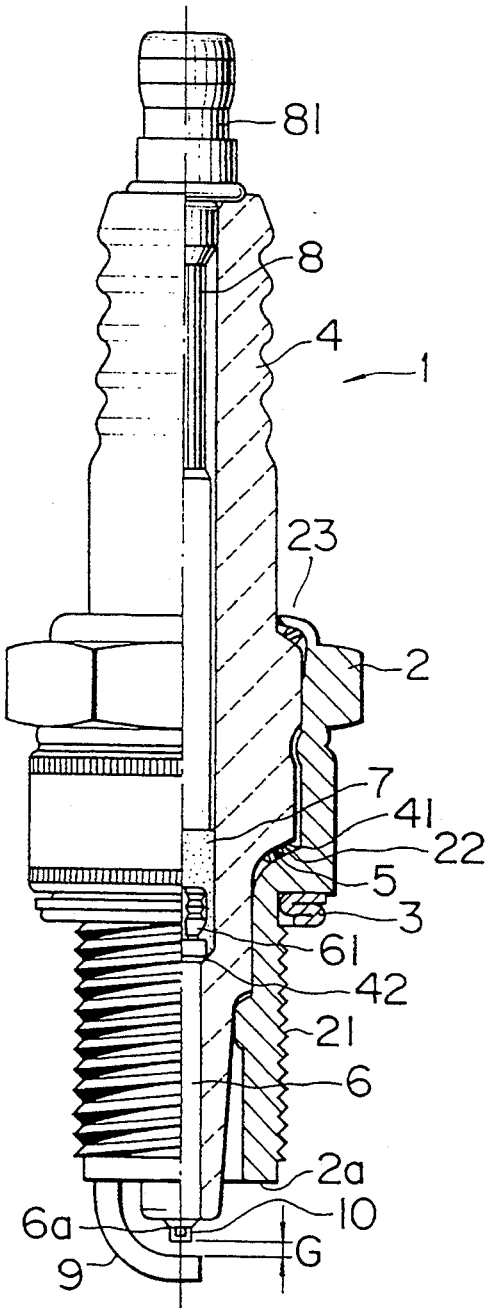
FIG. 1 is a view showing an overall construction of a spark plug according to a first embodiment of the invention.

FIG. 1 is a view showing an overall construction of a spark plug 1 used in an internal combustion engine, for example, of an automobile.

The spark plug 1 of a first embodiment shown in FIG. 1 is attached to a cylinder head of an internal combustion engine (not shown) through a screw portion 21 formed on an outer periphery of a lower portion of a metallic housing 2, and the interior of the cylinder head is kept air-tight by a gasket 3 fitted on the screw portion 21.

A lower half of a tubular insulator 4 extends through the housing 2, and a step 41 on the tubular insulator 4 and a step 22 on the housing 2 are held against each other through a seal member 5. The insulator 4 is fixed to the housing 2 by thermally compressing an upper end portion 23 of the housing 2.

A step 42 is formed on the inner surface of the lower end portion of the insulator 4, and a flange 61 formed on one end of a bar-like central electrode 6 is held against this step 42, thereby grounding the central electrode 6. The central electrode 6 is fixed to the insulator 4 by the step 42 and a glass seal material 7 which is fused to the flange 61 and the inner surface of the insulator 4. The other end of the central electrode 6 is projected from the lower end of the insulator 4. In order to enhance the thermal conductivity of the central electrode 6, the central electrode 6 comprises a core of copper and a cladding of a nickel-based alloy.

A central stem 8 is provided in the insulator 4, and is fixed by the glass seal material 7, the central stem 8 being in electrical contact with the glass seal material 7. The central stem 8 is in electrical contact with a terminal 81 projected from the upper end of the insulator 4.

One end of an earth electrode 9 is welded to an end surface 2a of the housing 2, and the earth electrode 9 is bent into a generally L-shape, so that the other end portion of this electrode 9 is disposed in opposed relation to the other end of the central electrode 6. A spark gap G is formed between the other end of the earth electrode 9 and a tip 10 of noble metal formed on the other end face 6*a* of the central electrode 6.

FIG. 2 shows the noble metal tip 10 and its surroundings on an enlarged scale.

The noble metal tip 10 has a cylindrical shape, and a cross-shaped groove 11 (which defines a recess-projection portion) is formed in that end face of the tip 10 joined to the central electrode 6, and the noble metal tip 10 has a flat portion 12 at the other end facing away from the groove 11. The end face of the noble metal tip 10 having the groove 11 (that is, sector-shaped pillar portions 13*a* to 13*d* defining the groove 11) is fixedly secured by resistance welding to a distal end face of a frusto-conical, reduced-diameter portion 6*b* formed on the other end face 6*a* of the central electrode 6. Namely, the thin flat portion 12 of the noble metal tip 10 facing away from the groove 11 is opposed to a discharge surface 9*a* of the earth electrode 9, and the flat portion 12 of the noble metal tip 10 and the discharge surface 9*a* of the earth electrode 9 define the spark gap G, and the pillar portions 13*a* to 13*d* are fixedly secured to the distal end face of the reduced-diameter portion 6*b* of the central electrode 6.

In this first embodiment, the noble metal tip 10 is made of an alloy composed of 80 wt. % platinum (Pt) and 20 wt. % iridium. The diameter of the tip 10 is 1.4 mm, and the groove 11 has the width of 0.3 mm and the depth of 0.5 mm, and the thickness of the flat portion 12 is 0.15 mm.

In this embodiment, the recess-projection portion of the noble metal tip 10 is provided by the cross-shaped groove 11, and with this cross-shape, the pillar portions 13*a* to 13*d* are formed, so that edges at which a spark discharge can be easily effected are obtained and many discharge portions can be obtained, and therefore a low spark voltage effect can be obtained. Thus, the cross-shaped groove 11 is defined by two straight groove portions intersecting each other. However, the groove may have a shape other than the cross-shape, in which case the low spark voltage effect can also be achieved.

Next, a method of producing the spark plug of the first embodiment and particularly a method of forming the noble metal tip 10 of the central electrode will now be described.

In a first step of the method of producing the spark plug of the first embodiment for an internal combustion engine, the insulator 4, the central electrode 6 and the earth electrode 9 are integrally joined together through the housing 2 in a known manner to provide a spark plug of a conventional construction.

Then, in a second step, before the noble metal tip 10 is welded to the central electrode 6, a cylindrical noble metal tip material 10*a* is forged into a desired shape having the cross-shaped groove 11, thereby providing the noble metal tip 10.

In a third or final step, the noble metal tip 10 of the desired shape is welded to the discharge surface 6*a* of the central electrode 6, thereby providing the spark plug of the first embodiment.

The spark discharge condition of the spark plug of the first embodiment which varies with time will now be described.

FIGS. 3(*a*) to (*d*) show the process of consumption of the noble metal tip 10 (which is joined to the discharge surface 6*a* of the central electrode 6 in the first embodiment) by the discharge.

In the spark plug of the first embodiment, at an initial stage of the discharge, the discharge gap G is formed by the discharge surface 9*a* of the earth electrode 9 and the flat portion 12 of the noble metal tip 10, as shown in FIG. 3(*a*). At this time, the discharge gap is thus defined by the two opposed surfaces, and therefore it is thought that this may affect the low spark voltage effect; however, at the initial stage of the discharge, the noble metal tip 10 is hardly consumed, and therefore the discharge gap G is sufficiently narrow to keep the spark voltage to a low level.

As the discharge time becomes long, the flat portion 12 of the noble metal tip 10 begins to be consumed, and the outer periphery of the flat portion 12 is consumed, so that the cross-shaped groove 11, formed in that surface of the noble metal tip 10 joined to the central electrode 6, begins to be exposed from the outer peripheral portion of the noble metal tip 10, as shown in FIG. 3(*b*). The discharge gap G becomes larger due to the consumption of the noble metal tip 10, which would necessitate a higher discharge voltage. However, as a result of the exposure of the groove 11, the edges of the groove 11 are exposed at the outer peripheral portion of the noble metal tip 10, thereby providing low discharge voltage portions, so that the discharge can be effected at a sufficiently low spark voltage as a Whole.

When the discharge further continues, the noble metal tip 10 of the spark plug 1 is further consumed, and the sector-shaped pillar portions 13*a* to 13*d* formed on the surface 6*a* of the central electrode 6 are all exposed, so that the spark gap G is formed by the discharge surface 9*a* of the earth electrode 9 and the pillar portions 13*a* to 13*d*, as shown in FIG. 3(*c*). Thus, one of the discharge surfaces for the discharge gap G has a cross-shape defined by the pillar portions 13*a* to 13*d*, and therefore the number of the edges required for the spark discharge is increased, so that the spark discharge can be easily effected. Therefore, even when the discharge gap G becomes large as a result of consumption of the noble metal tip 10, the discharge can be sufficiently effected at a low discharge voltage.

Until the noble metal tip 10 of the spark plug 1 of the first embodiment is completely consumed or eliminated, the discharge surface has the cross-shape defined by the pillar portions 13*a* to 13*d*, as shown in FIG. 3(*d*), and therefore the low-voltage spark discharge can be maintained until the noble metal is completely consumed. In addition, that portion of the reduced-diameter portion 6*b* defining the bottom 14 of the groove 11 is oxidized and recessed, and therefore the apparent length of the pillar portions 13*a* to 13*d* becomes long, so that the groove 11 becomes deeper, thereby further maintaining the low spark voltage effect.

Figure 4:
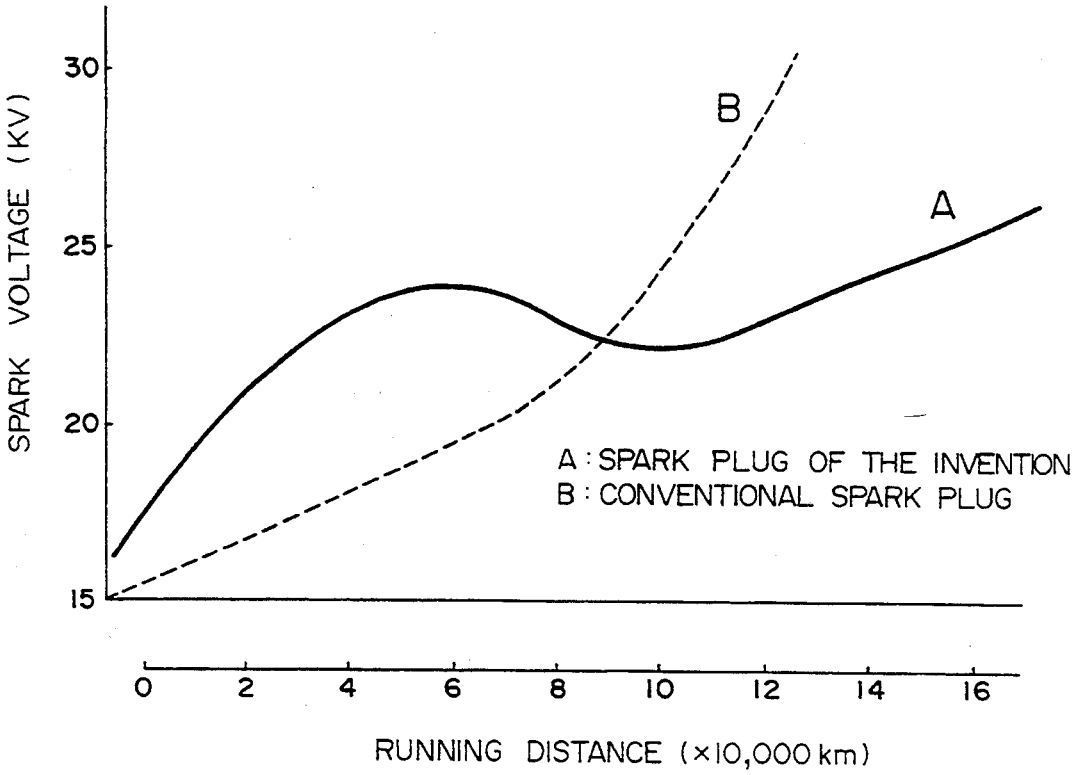
FIG. 4 is a graph showing a characteristic comparison between the spark plug of the first embodiment and a conventional spark plug.

FIG. 4 shows the relation between the running distance of an automobile and the spark voltage of each of the spark plug of the first embodiment and a conventional spark plug, this conventional spark plug having a groove or a recess-projection portion at or near a discharge surface of a central electrode.

Figures 9A, 9B, 9C, 9D:
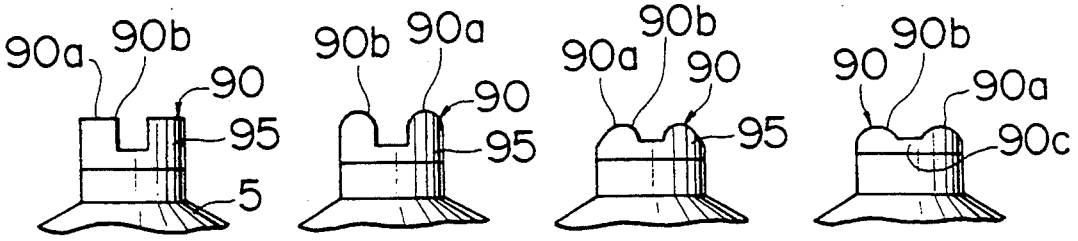
FIG. 9(a) (PRIOR ART) FIG. 9(b) (PRIOR ART) FIG. 9(c) (PRIOR ART) FIG. 9(d) (PRIOR ART)
FIGS. 9(*a*) to (*d*) are schematic views showing the degree of consumption of a conventional noble metal tip proceeding with the discharge time.

In FIG. 4, a line A represents the spark plug of the first embodiment, and a line B represents the conventional spark plug as shown in FIG. 9.

Here, the spark voltage is the maximum spark voltage measured under an evaluation condition of a full load × 1000 rpm in a four-stroke, four-cylinder engine (1600 cc).

The noble metal tips of the two spark plugs used in the test had the same size as in the first embodiment, and these spark plugs differed from each other only in the manner of joining the noble metal tip to the central electrode.

As is clear from FIG. 4, at the initial stage of the use as shown in FIGS. 3(*a*) and 9(*a*), although the spark voltage of the conventional noble metal tip is lower than the spark voltage of the noble metal tip of the first embodiment, the spark voltage of the noble metal tip of the first embodiment is also kept sufficiently low, that is, within an allowable range.

As the running distance increases to approach 100,000 km (FIGS. 3(*b*)–3(*c*) and FIGS. 9(*b*)–9(*c*)), the sector-shaped pillar portions (which define the recess-projection portion of the discharge surface) of the conventional noble metal tip are consumed to become shorter as described above, so that the spark voltage reduction effect tends to disappear. On the other hand, in the noble metal tip of the first embodiment, the groove 11 begins to be exposed as described above, and therefore the spark voltage reduction effect begins to appear.

When the running distance further increases, the noble metal tips have their respective shapes shown in FIGS. 3(*d*) and 9(*d*). The discharge surface of the conventional noble metal tip becomes generally flat as shown in FIG. 9(*d*), so that the spark voltage is abruptly increased as shown in FIG. 4. On the other hand, in the noble metal tip of the first embodiment, since the groove 11 is formed by the pillar portions 13*a* to 13*d* of the noble metal tip 10, the low spark voltage effect is maintained, and as a result even when the running distance reaches 160,000 km, the low spark voltage effect can be sufficiently maintained. This indicates that the spark voltage reduction effect is achieved.

Figure 5:
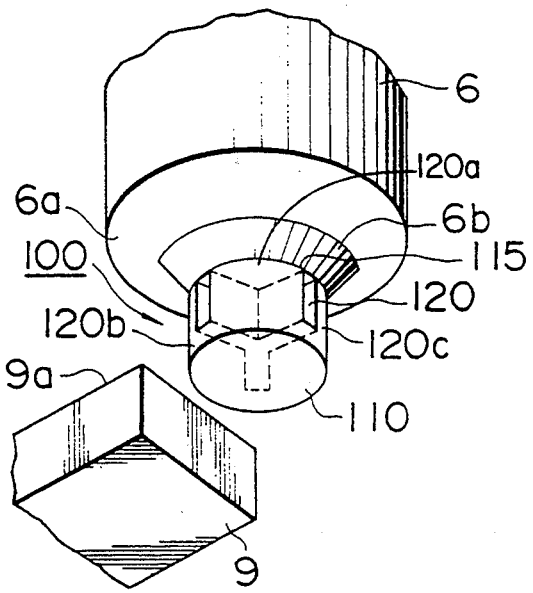
FIG. 5 is a view similar to FIG. 2, but showing a second embodiment of the invention.

FIG. 5 shows a noble metal tip 100 of a second embodiment and its surroundings on an enlarged scale.

The noble metal tip 100 has one end face 110 disposed in opposed relation to an earth electrode 9, and the other end face 115 which faces away from the face 110 and has a groove 120 formed therein.

Particularly, the groove 11 in the first embodiment is merely of a cross-shape whereas in the second embodiment, the groove 120 formed in the other end face 115 of the noble metal tip 100 has a generally Y-shape defined by three radially-extending groove portions (In other words, the groove 120 has no straight groove portion extending across the noble metal tip 100).

With this Y-shaped groove configuration, pillar portions 120*a*, 120*b* and 120*c* are formed. The other end face 115 having the groove 120 formed therein is joined by resistance welding to a reduced-diameter portion 6*b* formed on an end face 6*a* of a central electrode 6. A spark gap G is formed by the one end face 110 of the noble metal tip 100 and the discharge surface 9*a* of the earth electrode 9.

The noble metal tip 100 of the central electrode in the second embodiment is formed by the same method as described in the first embodiment.

As described above, the noble metal tip 100 in the second embodiment has the generally Y-shaped groove 120 having no straight groove portion extending across the noble metal tip 100, and with this groove configuration, the strength of the noble metal tip 100 is increased.

Namely, in the case where the groove in the noble metal tip has a cross-shape as in the first embodiment, or a straight shape defined by a single groove portion extending across the noble metal tip, the noble metal tip may be deformed by an external force when the discharge member is transferred in a factor usually by a part feeder of the vibration type.

Figure 6A:
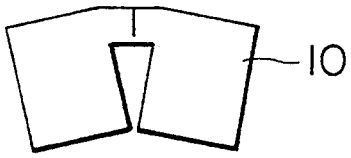
FIGS. 6(*a*) and 6(*b*) are views showing the condition of breakage of the noble metal tip.
Figure 6B:
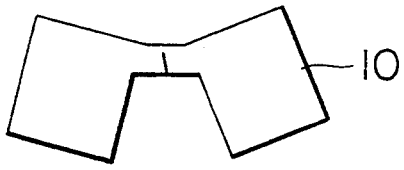

FIGS. 6(*a*) and 6(*b*) show examples of deformation of the noble metal tip 10 of the first embodiment. If this deformation is severe, even a crack develops in the noble metal tip 10 as shown in FIGS. 6(*a*) and 6(*b*), so that the noble metal tip 10 is broken.

On the other hand, since the groove 120 in the noble metal tip 100 of the second embodiment has the generally Y-shape having no straight groove portion extending across the noble metal tip, the noble metal tip 100 will not be subjected to breakage.

Figure 7:
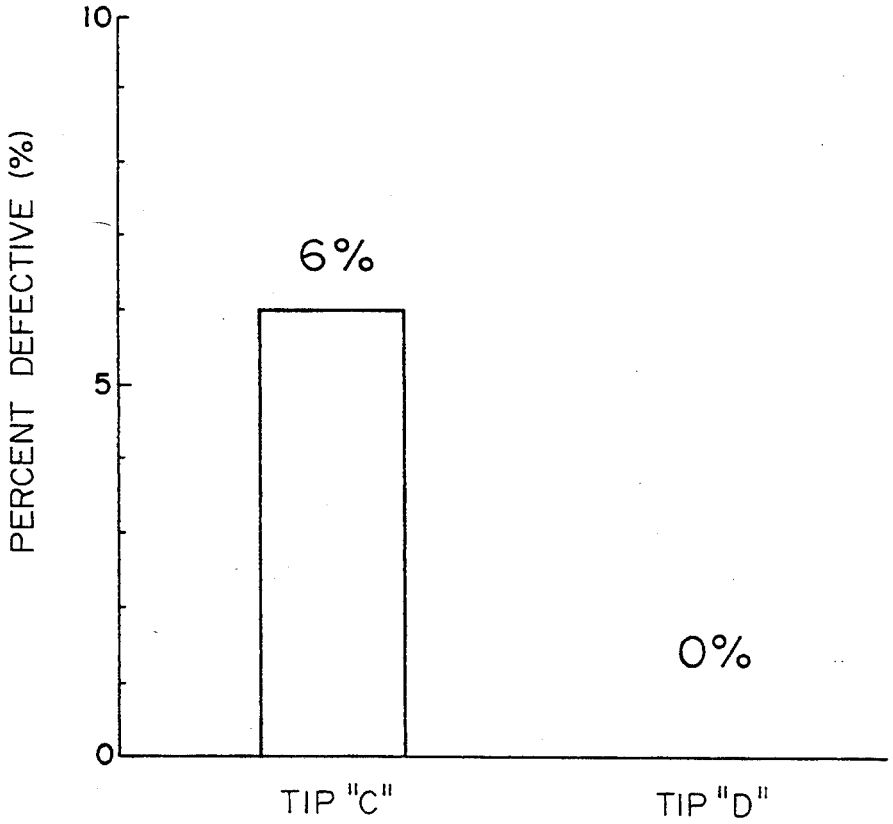
FIG. 7 is a graph showing a percent defective of the noble metal tips of the first and second embodiments.

FIG. 7 shows results of transfer tests for the noble metal tips of the first and second embodiments.

In this transfer step, each noble metal tip to be welded to the central electrode was first transferred to a predetermined position by a vibration-type part feeder while confirming the obverse and reverse of the tip, and then the noble metal tip was held by a pincette or the like, and was positioned on the distal end face of the central electrode.

With respect to each noble metal tip C of the first embodiment used for the transfer test, its diameter was 1.4 mm, the groove width was 0.3 mm, the groove depth was 0.5 mm, and the thickness of the flat portion was 0.15 mm. With respect to each noble metal tip D of the second embodiment used for the transfer test, its diameter was 1.4 mm, the groove width was 0.3 mm, the groove depth was 0.5 mm, and the thickness of the flat portion was 0.15 mm. 1000 noble metal tips C and 1000 noble metal tips D were fed to the transfer step. Results thereof are shown in FIG. 7.

In FIG. 7, the ordinate axis indicates a percent defective representing the ratio of defective pieces (subjected to deformation or cracking as shown in FIGS. 6(*a*) and 6(*b*)) per the tested tips.

As is clear from FIG. 7, about 6% of the tested noble metal tips C of the first embodiment became defective because of the groove configuration thereof, whereas none of the tested noble metal tips D of the second embodiment became defective since they had a sufficient strength to withstand vibrations because the groove thereof had no straight groove portion extending across the noble metal tip.

In the present invention, it is preferable that the groove is of a cross-shape as shown in the first embodiment, and is of such a configuration that it has no straight groove portion extending across the noble metal tip as shown in the second embodiment. However, the groove is not limited to such configuration, and may have other configurations as shown in FIGS. 8(*a*) to 8(*f*).

Figures 8A, 8B, 8C:
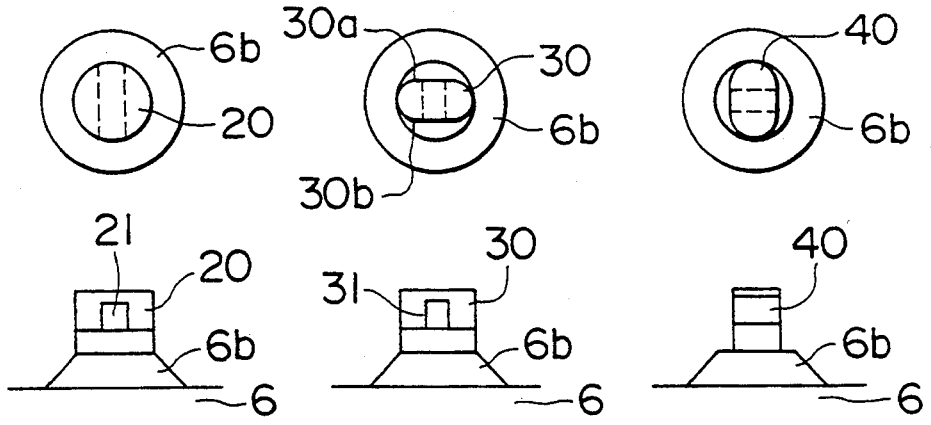
FIGS. 8(*a*) to 8(*f*) are views showing modified noble metal tips of the invention and the surroundings thereof.
Figures 8D, 8E, 8F:
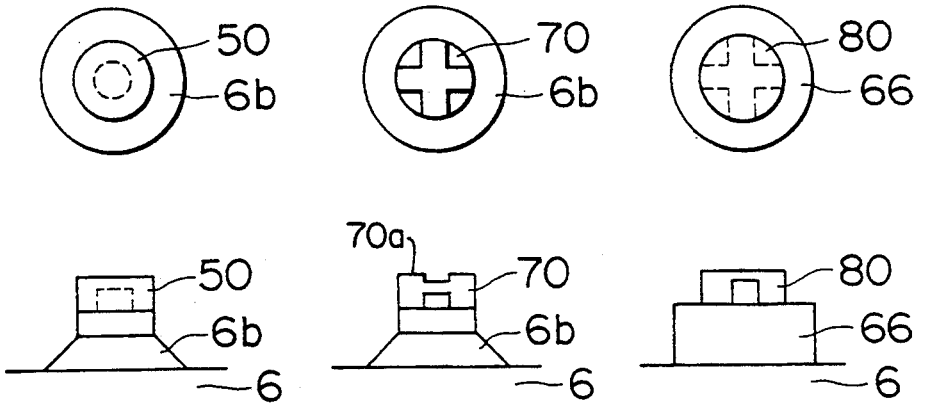

FIG. 8(*a*) shows a noble metal tip 20 in which a straight groove 21 is formed.

In the above embodiments, although the cross-shaped groove is formed in the cylindrical noble metal tip of a circular cross-section, a noble metal tip 30 of an oval cross-section may be used as shown in FIG. 8(*b*), in which case a groove 31 extends from one straight surface 30*a* to the other straight surface 30*b*.

FIG. 8(*c*) shows a noble metal tip 40 which is obtained by turning the noble metal tip 30 of FIG. 8(*b*) through 90 degrees. With this arrangement, the spark discharge effect can also be achieved.

FIG. 8(*d*) shows a noble metal tip 50 in which a recess-projection configuration is circular.

FIG. 8(*e*) shows a noble metal tip 70 in which not only a groove is formed in that surface of the tip 70 joined to a reduced-diameter portion 6*b* of a central electrode 6, but also a cross-shaped groove is formed in a discharge surface 70*a*.

In the first embodiment, although the reduced-diameter portion 6*b* of the central electrode 6 has a frusto-conical shape, a reduced-diameter portion 66 of a noble metal tip 80 shown in FIG. 8(*f*) has a cylindrical shape.

In the above embodiments, the noble metal tip is made of a platinum alloy having an excellent thermal consumption resistance, and should preferably comprise platinum as a main component, and additives such as iridium, rhodium, tungsten and nickel, and also a small amount of a rare earth element as an additive.

In the above embodiments, although the noble metal tip is used as the discharge member, the material of the discharge member is not limited to the noble metal tip, and for example, the tip having the same configuration as the noble metal tip may be made of a nickel-based alloy similar to that constituting the electrode substrate.

The discharge member may be integral with the central electrode or the earth electrode.

What is claimed is:

1. A spark plug including a first electrode and a second electrode opposed to one another, said first electrode having a discharge member in opposed facing relation to said second electrode to define a discharge gap therebetween, said discharge member having at least one of a bore and a groove therein to a depth less than a thickness of said discharge member, said discharge member comprising a first portion of predetermined thickness and a second portion having said at least one groove or bore defined therethrough, said first portion being intermediate said second portion and said second electrode, whereby after said first portion is consumed by discharge between said first and second electrodes, said second portion is exposed and in opposed facing relation to said second electrode.

2. A spark plug as claimed in claim 1, wherein said discharge member comprises a noble metal tip.

3. A spark plug including a first electrode and a second electrode opposed to one another, said first electrode having a discharge member having a first portion of predetermined thickness that faces the second electrode and a second portion having at least one through hole defined therethrough, said first portion being intermediate said second portion and said second electrode, whereby after said first portion is consumed by discharge between said first and second electrodes, said second portion is exposed and in opposed facing relation to said second electrode.

4. A spark plug as claimed in claim 3, wherein said through hole intersects a central axis of said discharge member.

5. A spark plug as claimed in claim 3, wherein there are two through holes, said through holes intersecting one another.

6. A spark plug as claimed in claim 4, wherein there are three through holes each extending radially from said central axis.

7. A spark plug as claimed in claim 4, wherein said at least one through hole has a generally square cross-section.

8. A spark plug as claimed in claim 5, wherein said at least one through hole has a generally square cross-section.

9. A spark plug as claimed in claim 6, wherein said at least one through hole has a generally square cross-section.

10. A spark plug as claimed in claim 3, wherein said discharge member is formed from a noble metal.

11. A spark plug as claimed in claim 3, wherein an end surface of said discharge member has at least one groove defined therein.

12. A spark plug as claimed in claim 3, wherein said discharge member is generally cylindrically shaped.

13. A spark plug as claimed in claim 3, wherein said discharge member is a generally elliptical cylindrical shape.

14. A spark plug including a first electrode and a second electrode disposed opposed to one another, said first electrode having a discharge member defining a discharge gap with said second electrode, said discharge member having a first portion of predetermined thickness and a second portion having a cavity defined therein, said first portion being intermediate said second portion and said second electrode, whereby after said first portion is consumed by discharge between said first and second electrodes, said second portion is exposed and in opposed facing relation to said second electrode.

* * * * *